US009051701B2

(12) United States Patent
Westcott

(10) Patent No.: US 9,051,701 B2
(45) Date of Patent: Jun. 9, 2015

(54) WATER SKIMMER APPARATUS AND METHOD FOR REMOVING WATER FROM A WATER CONTAINMENT SYSTEM

(76) Inventor: Michael B. Westcott, Jamestown, NC (US)

( * ) Notice: Subject to any disclaimer, the term of this patent is extended or adjusted under 35 U.S.C. 154(b) by 294 days.

(21) Appl. No.: 13/606,087

(22) Filed: Sep. 7, 2012

(65) Prior Publication Data

US 2013/0092268 A1 Apr. 18, 2013

Related U.S. Application Data

(60) Provisional application No. 61/547,386, filed on Oct. 14, 2011.

(51) Int. Cl.

| | |
|---|---|
| ***E03B 3/04*** | (2006.01) |
| ***E02B 8/00*** | (2006.01) |
| *E03B 11/00* | (2006.01) |

(52) U.S. Cl.

CPC . *E02B 8/00* (2013.01); *E03B 11/00* (2013.01); *E03B 3/04* (2013.01)

(58) Field of Classification Search

CPC ..... E02B 8/00; E03B 3/00; E03B 3/04; E03B 11/00

USPC ..... 210/747.6, 776, 122, 170.05, 170.09, 210/170.1, 242.1, 242.3; 405/127

See application file for complete search history.

(56) References Cited

U.S. PATENT DOCUMENTS

| | | | | |
|---|---|---|---|---|
| 3,109,812 | A * | 11/1963 | McAulay et al. | 210/242.1 |
| 4,647,374 | A * | 3/1987 | Ziaylek et al. | 210/242.1 |
| 4,892,666 | A * | 1/1990 | Paulson | 210/776 |
| 4,973,405 | A * | 11/1990 | Kozey | 210/242.1 |
| 5,052,855 | A * | 10/1991 | Chapman et al. | 210/242.1 |
| 5,113,889 | A * | 5/1992 | McGuire, Jr. | 405/127 |
| 5,326,475 | A * | 7/1994 | Kent | 210/747.6 |
| 5,417,553 | A * | 5/1995 | Gibson et al. | 417/366 |
| 5,451,330 | A * | 9/1995 | Garrett | 210/776 |
| 5,820,751 | A | 10/1998 | Faircloth, Jr. | |
| 6,821,415 | B2 | 11/2004 | Sharb | |
| 7,473,373 | B1 | 1/2009 | Danler | |
| 7,504,037 | B2 * | 3/2009 | Gibbs | 210/776 |
| 7,762,741 | B1 | 7/2010 | Moody | |
| 7,790,023 | B1 | 9/2010 | Mills | |
| 7,794,589 | B2 | 9/2010 | Kozey | |
| 7,985,035 | B2 | 7/2011 | Moody | |

* cited by examiner

*Primary Examiner* — Christopher Upton

(74) *Attorney, Agent, or Firm* — Smith Moore Leatherwood LLP; Matthew S. Bedsole

(57) ABSTRACT

The current invention is directed to a water skimmer and method of using same in a water containment system where the water skimmer comprises a conduit and float material. The conduit has water apertures and air apertures. The conduit and the float material are adapted to maintain a approximately a 1.5 inch to 6 inch head of water above the water apertures while keeping the air apertures at or above the water level. The number and size of the water apertures in the conduit allow for a predetermined flow rate of water.

21 Claims, 10 Drawing Sheets

WATER SKIMMER APPARATUS AND METHOD FOR REMOVING WATER FROM A WATER CONTAINMENT SYSTEM

The present invention is directed towards a water skimmer. This application claims the benefit of U.S. Provisional Application No. 61/547,386, filed Oct. 10, 2011, the disclosure of which is expressly incorporated herein by reference.

BACKGROUND

Water containment systems are designed to hold water and various pollutants, particles, and objects found in the water until such time as the water can be removed in such a manner that those pollutants, particles, and objects are left behind. In some cases, the water containment system is a basin or container. In other cases, the water containment system is a water reservoir to hold water runoff during construction. Generally, a water containment system is designed to allow for an influx of water holding the various pollutants, particles, and objects and the outlet of relatively clean water. The water is clean relative to the amount of pollutants, particles, and objects found in the water containment system. Such water containment systems are usually not designed to purify the water exiting the system.

The rate of water influx and outlet is important to the design of a water containment system to insure the water containment system does not overflow, thereby sending the various pollutants, particles, and/or objects into the surrounding environment, or dry up, potentially clogging the outlet system and/or sending the various pollutants, particles, and/or objects into the area where the relatively clean water was being sent. Therefore, it is important to know the flow rate of the water exiting the system. The current invention provides for an apparatus and method for removing relatively clean water from a water containment system.

SUMMARY

In one embodiment of the current invention, a water skimmer for removing water from a water containment system through a water outlet has a conduit having a height comprised of one or more conduit structures; and float material. In one aspect, the conduit defines one or more air apertures and one or more water apertures. In another aspect of the current invention, the float material and height of the conduit are adapted to maintain between approximately a 1.5 inch to 6 inch head of water above the water apertures and maintain the air apertures at or above the water level of the water containment system. In yet another aspect of the current invention, water from the water containment system is gravity fed through the water apertures. In another aspect of the current invention, the flow rate of water through the water apertures is determined by the number and size of the water apertures.

In another embodiment of the current invention, the water skimmer has at least one connector integral to or in communication with the conduit, where the connector is adapted to engage a water outlet, and one or more supports integral to or in communication with said conduit, where the supports are adapted to hold the conduit substantially above the bottom of the water containment system when the supports contact the bottom. In one aspect of the current invention, the float material is integral to or in communication with the conduit, the at least one connector, the one or more supports, or any combination thereof.

In an aspect of the current invention, the conduit, at least one connector, one or more supports, or any combination thereof are made of solid core pipe, foam core pipe, or any combination thereof. In another aspect, the float material is in communication with the solid core pipe, foam core pipe, or any combination thereof In a further aspect of the current invention, the conduit, at least one connector, one or more supports, or any combination thereof is made of polyvinyl chloride, acrylonitrile butadiene styrene, high-density polyethylene, any similar material known to one having ordinary skill in the art, or any combination of the proceeding.

In another aspect of the current invention, the water skimmer includes one or more supports integral to or in communication with the conduit; and the supports are adapted to hold the conduit substantially above the bottom of said water containment system when said supports contact said bottom. In a further aspect, the one or more supports are removably attached to said conduit. In another aspect, at least one of said supports is comprised of foam core acrylonitrile butadiene styrene pipe.

In another embodiment of the current invention, the water skimmer has a cover in communication with said conduit where the cover is adapted to be adjustable to cover or uncover one or more of the water apertures. In one aspect, the cover is a rubber sleeve.

In one aspect of the current invention, the water skimmer has two or more water apertures wherein the size of said water apertures are the same, different, or any combination thereof.

In another aspect of the current invention, the number of said water apertures is greater than one, and the size of said water apertures is less than the size of a predetermined water aperture, where the flow rate of water through said water apertures is at or about the flow rate of water through one predetermined water aperture.

In one aspect, the number of the water apertures is greater than one and the size of the water apertures is less than one inch, where the flow of water through said water apertures is at or about the flow rate of a one inch size predetermined water aperture.

In one aspect, the number of the water apertures is greater than one and the size of the water apertures is less than 1.5 inches, where the flow of water through said water apertures is at or about the flow rate of a 1.5 inch size predetermined water aperture.

In one aspect, the number of the water apertures is greater than one and the size of the water apertures is less than two inches, where the flow of water through said water apertures is at or about the flow rate of a two inch size predetermined water aperture.

In one aspect, the number of the water apertures is greater than one and the size of the water apertures is less than three inches, where the flow of water through said water apertures is at or about the flow rate of a three inch size predetermined water aperture.

Another embodiment of the current invention is a method of removing water from a water containment system by providing a water skimmer having a conduit having a height comprised of one or more conduit structures, where said conduit defines one or more air apertures and one or more water apertures; and float material, where the float material and height of the conduit are adapted to maintain between approximately a 1.5 inch to 6 inch head of water above the water apertures and maintain the air apertures at or above the water level of said water containment system; and connecting said water skimmer for transferring water from the water containment system to a water outlet; placing said water skimmer into said water containment system; allowing water from said water containment system to be gravity fed through the water apertures to said water outlet; and maintaining water outlet in communication with an area outside the water reservoir.

In one aspect of an embodiment of the current invention, the water outlet is adapted to move vertically in relation to said water level.

In one embodiment of the current invention, a water skimmer for removing water from a water containment system through a water outlet is made up of a conduit having a height comprised of one or more conduit structures, wherein said conduit defines one or more air apertures and one or more water apertures; one or more supports integral to or in communication with said conduit; wherein said one or more supports are adapted to hold the conduit substantially above the bottom of said water containment system when said supports contact said bottom; at least one connector integral to or in communication with said conduit; wherein said connector is adapted to engage said water outlet; float material integral to or in communication with the conduit, the one or more supports, the connector, or any combination thereof, where the float material and height of the conduit are adapted to maintain between approximately a 1.5 inch to 6 inch head of water above the water apertures and maintain the air apertures at or above the water level of said water containment system, where water from the water containment system is gravity fed through the water skimmer to a water outlet, and where the flow rate of said water through said water skimmer is determined by the number and size of the water apertures. In one aspect, the water skimmer also has a cover in communication with the conduit, where the cover is adapted to be adjustable to cover or uncover one or more of the water apertures.

Numerous other aspects of embodiments, embodiments, features, and advantages of the present invention will appear from the following detailed description and the accompanying drawings. In the description and/or the accompanying drawings, reference is made to exemplary aspects of embodiments and/or embodiments of the invention which can be applied individually or combined in any way with each other. Such aspects of embodiments and/or embodiments do not represent the full scope of the invention. Reference should therefore be made to the claims herein for interpreting the full scope of the invention. In the interest of brevity and conciseness, any ranges of values set forth in this specification contemplate all values within the range and are to be construed as support for claims reciting any sub-ranges having endpoints which are real number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Also in the interest of brevity and conciseness, it is to be understood that such terms as "is," "are," "includes," "having," "comprises," and the like are words of convenience and are not to be construed as limiting terms and yet may encompass the terms "comprises," "consists essentially of," "consists of," and the like as is appropriate.

These and other aspects, advantages, and salient features of the present invention will become apparent from the following detailed description, the accompanying drawings, and the appended claims.

DETAILED DESCRIPTION

Figure 1A:
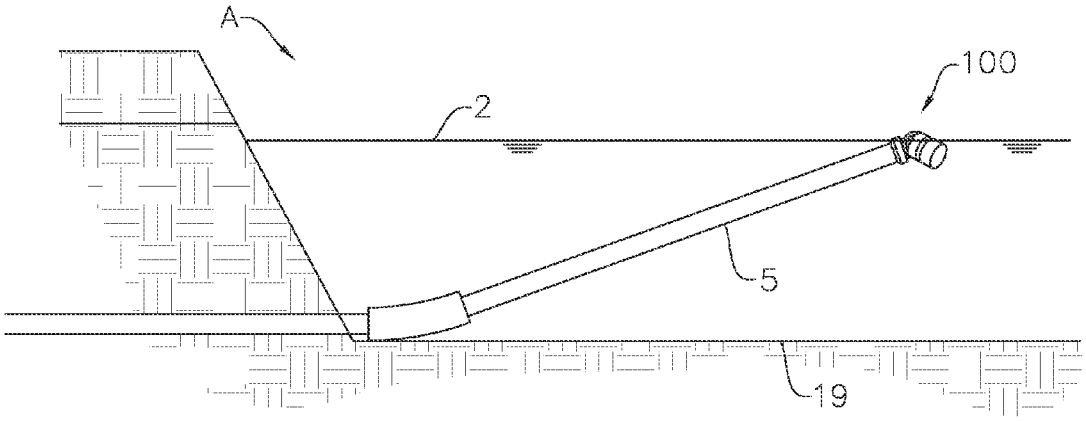
FIG. 1A is a representation of a water containment system with water with an embodiment of the current invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

While typical aspects of embodiment and/or embodiments have been set forth for the purpose of illustration, the foregoing description and the accompanying drawings should not be deemed to be a limitation on the scope of the invention. Accordingly, various modifications, adaptations, and alternatives may occur to one skilled in the art without departing from the spirit and scope of the present invention. It should be understood that all such modifications and improvements have been deleted herein for the sake of conciseness and readability but are properly within the scope of aspects of embodiments of the present invention. Numerous other aspects of embodiments, embodiments, features, and advantages of the present invention will appear from the description and the accompanying drawings. In the description and/or the accompanying drawings, reference is made to exemplary aspects of embodiments and/or embodiments of the invention, which can be applied individually or combined in any way with each other.

The present invention is a water skimmer for removing water from a water containment system through a water outlet. The water skimmer operates by limiting the movement of water from the water containment system to the water outlet using uniquely sized and numbered water apertures. The water in the water containment system A moves into and through the water skimmer 100, into a water outlet 5, and out of the water containment system A, as shown in FIG. 1A.

Figure 2:
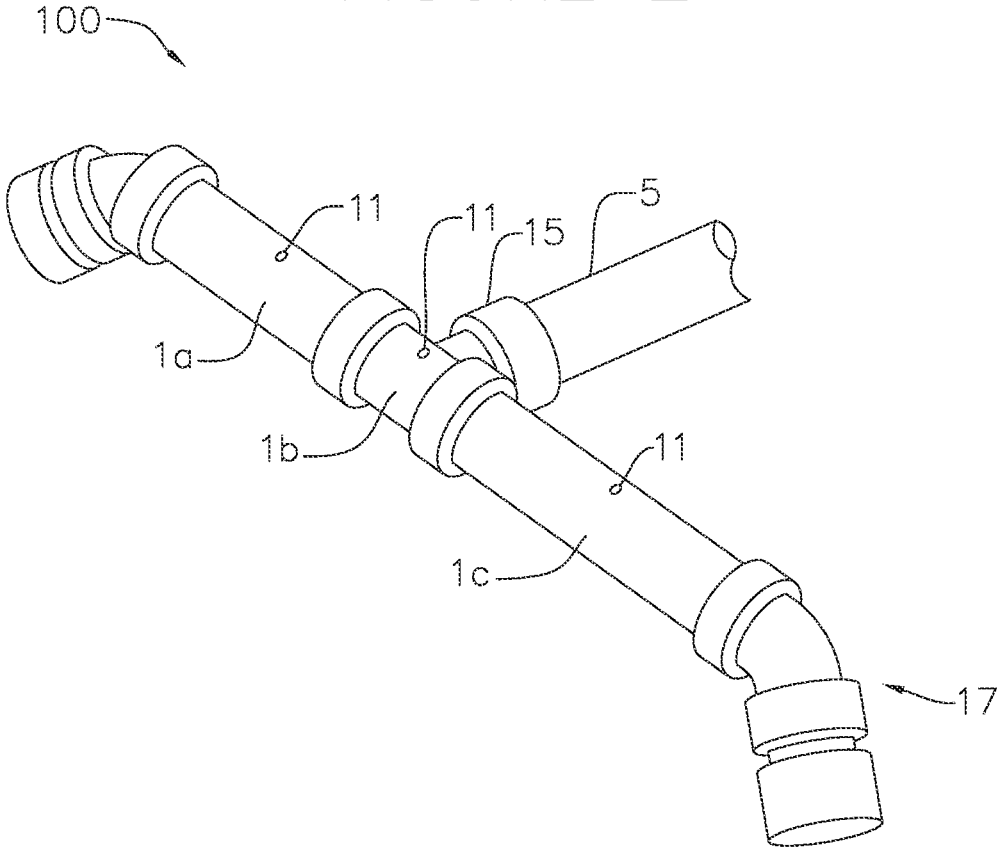
FIG. 2 is a perspective view of the top of an embodiment of the current invention.
Figure 3:
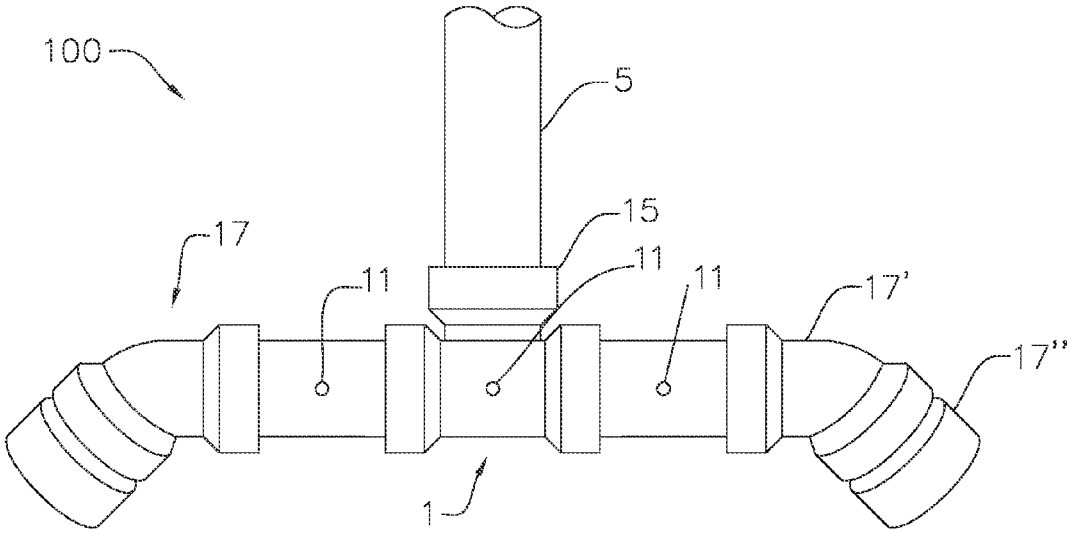
FIG. 3 is a plane view of an embodiment of the current invention.
Figure 4:
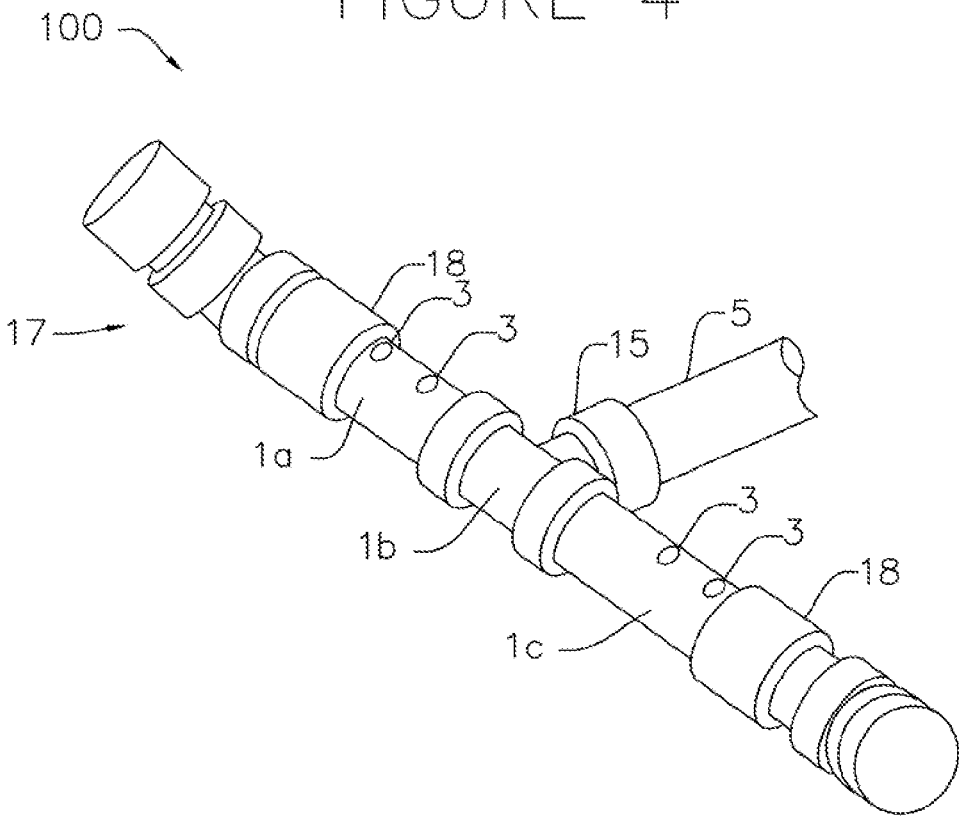
FIG. 4 is a bottom plane view of an embodiment of the current invention.
Figure 5:
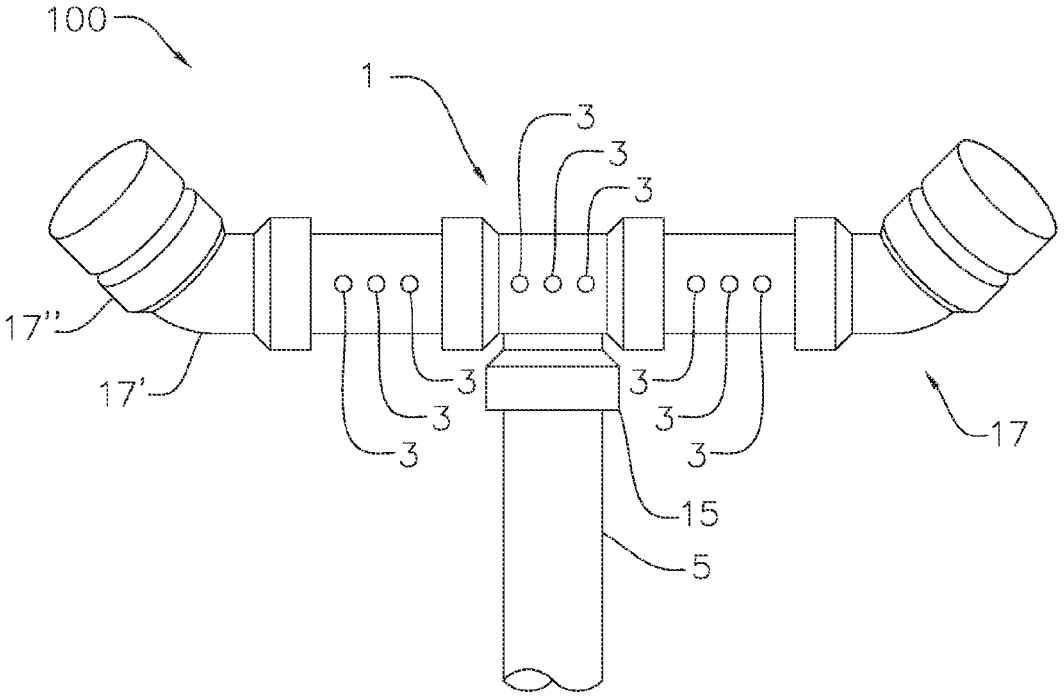
FIG. 5 is a bottom view of an embodiment of the current invention.
Figure 7:
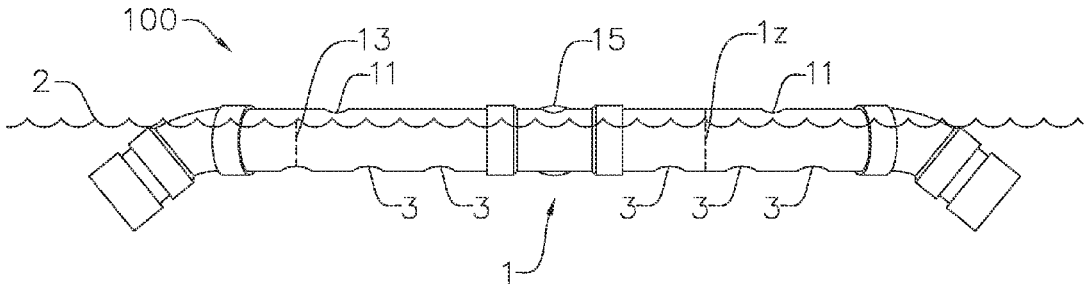
FIG. 7 is a front view of an embodiment of the current invention.
Figure 8:
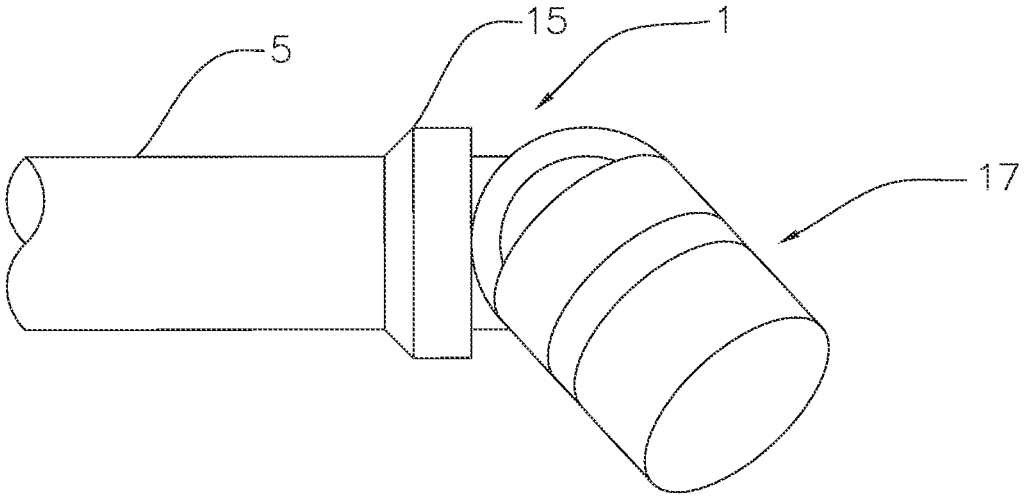
FIG. 8 is a side elevational view of an embodiment of the current invention.

The water skimmer 100 as seen in FIGS. 2 and 3 is comprised of a conduit 1 which may be formed from one or more conduit structures 1*a*, 1*b*, 1*c*. The conduit 1 may be made of polyvinyl chloride (PVC), acrylonitrile butadiene styrene (ABS), high-density polyethylene (HDPE) or other similar material known to one having ordinary skill in the art upon reading this application. The material may be any color, such as white or black. In one aspect of the current invention, the material is black or a dark color to facilitate passive solar heating. The conduit 1, with or without conduit structures 1*a*, 1*b*, 1*c*, form a passage through which water moves from the water containment system A, as seen in FIG. 1A; through one or more water apertures 3, as seen in FIGS. 4 and 5; through the conduit 1; and into a water outlet 5. The height 1*z* of the inside of the conduit 1, as seen in FIG. 7, may be any size greater than one inch. The conduit 1 and/or conduit structures

1*a*, 1*b*, 1*c* may be any shape, such as square, oval, round, or triangular. The conduit 1 may be comprised of solid core pipe, foam core pipe, or any other such structure known or may become known to one having ordinary skill in the art upon reading this application. A solid core pipe generally is composed of the same or similar material throughout the pipe. A foam core pipe generally is composed of one material comprising the interior and exterior layers of the pipe and a lighter or less dense material between said interior and exterior layers. The conduit 1 may be comprised of both solid core pipe and foam core pipe. For instance, conduit structures 1*a* and 1*c* may be foam core pipe and conduit structure 1*b* may be solid core pipe, or vice versa.

Figure 6:
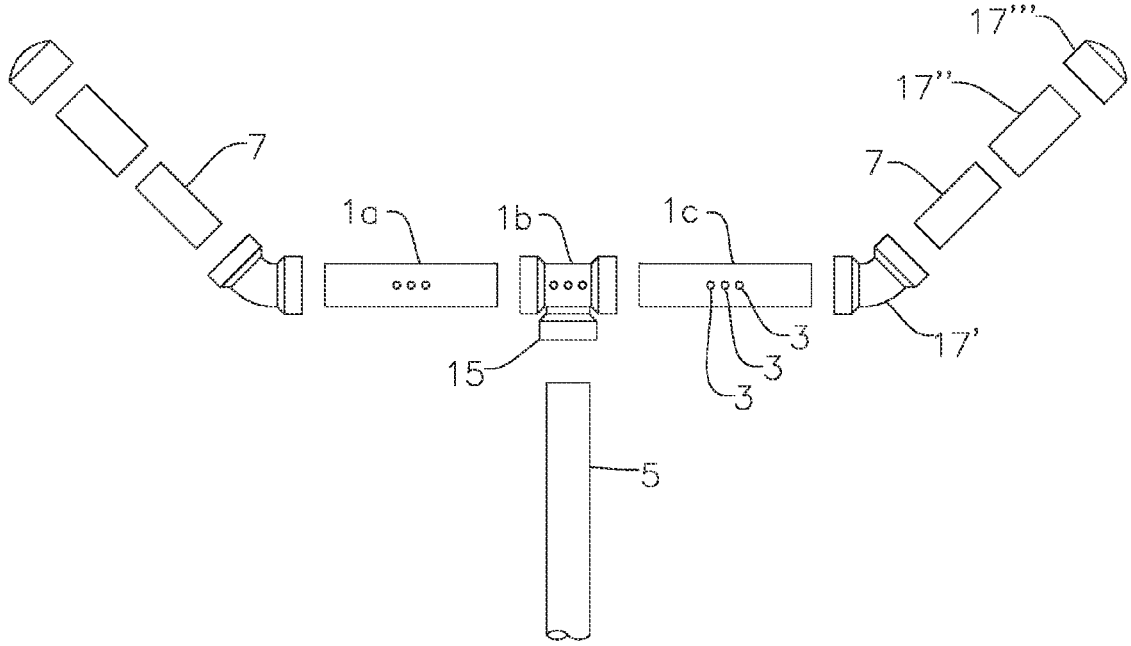
FIG. 6 is an exploded view of an embodiment of the current invention.

The water skimmer 100 may comprise float material 7, as seen in FIG. 6. The float material 7 may be any material integral to or in communication with the water skimmer 100, such as integral to or in communication with the conduit 1, which acts to allow the water skimmer 100 to float at the surface of the water level 2 of the water containment system. In one embodiment, a foam core pipe may, in whole or in part, be the float material 7 holding the skimmer aloft in the water containment system. The amount and characteristics of the float material 7 and the height 1*a* of the conduit 1 work together to position the water skimmer 100 at the water level 2 of the water containment system such that the one or more air apertures 11 found on the top of the water skimmer 100 in the conduit 1 are at or above the surface of the water level 2 of the water containment system as seen in FIGS. 6 and 7 and the head 13 of water, which is the depth of water above the water apertures 3, is kept substantially consistently between approximately 1.5 inches and 6 inches. The water skimmer 100 is substantially consistently in the position to have between approximately 1.5 inches and 6 inches of head 13 of water above the water apertures 3 when the majority of the time the water skimmer is in use it is located in that position within the water containment system. Examples of float material 7 include, but are not limited to, foam core pipe, polystyrene foam, extruded polystyrene foam, and other materials known to one having ordinary skill in the art.

The one or more air apertures 11 are inlets through which air passes to facilitate the movement of water through the water apertures 3 which are located on the side of the skimmer generally opposite said one or more air apertures 11. For example, the one or more air apertures 11 are located on the top of skimmer such that the air apertures 11 are at or above the surface of the water level 2 of the water containment system and the water apertures 3 are below the surface of the water level 2 of the water containment system such that the head 13 of water is between approximately 1.5 and 6 inches deep above the water apertures 3. The flow of water through the water apertures 3 is gravity fed and may additionally include pumping or suction, not shown, to further facilitate the flow of water. A gravity fed water skimmer will be known to those having ordinary skill in the art as referring to a device using the characteristic of water to move from a high point to a lower point without outside energy being applied to the system to move the water. In this case, the water moves through the water apertures 3, into the conduit 1, then to a water outlet 5 which is generally positioned to be lower than the conduit as seen in FIG. 1A.

The water outlet 5 is any structure which allows the water to move from its position in the conduit 1 to an area outside the water containment system. For example, in FIG. 1A, the water outlet is a pipe in communication with the conduit 1 and is positioned in such a way as to allow water from the water containment system to flow downward, as is expected in a gravity fed system, and out of the water containment system through any water containment system borders.

The water skimmer 100 may include a connector 15 which is adapted to engage the water outlet 5 as seen in FIG. 2-5. The connector 15 may be integral to or in communication with the conduit 1. The connector 15 and the water outlet 5 and/or the conduit 1 may be chemical engaged, such as through the use of adhesives, or mechanically engaged, such as through O-rings, friction fits, or threads. In one embodiment, connector 15 may comprise threads to allow it to threadingly engage the water outlet 5. The connector 15 is sized to be the same or greater than the predetermined water aperture 30 size as discussed in further detail below. As such, the connector 15 does not limit the flow rate of water from the conduit 1 to the water outlet 5. The connector 15 may comprise float material 7. In one embodiment, the connector 15 may comprise foam core pipe.

Figure 1B:
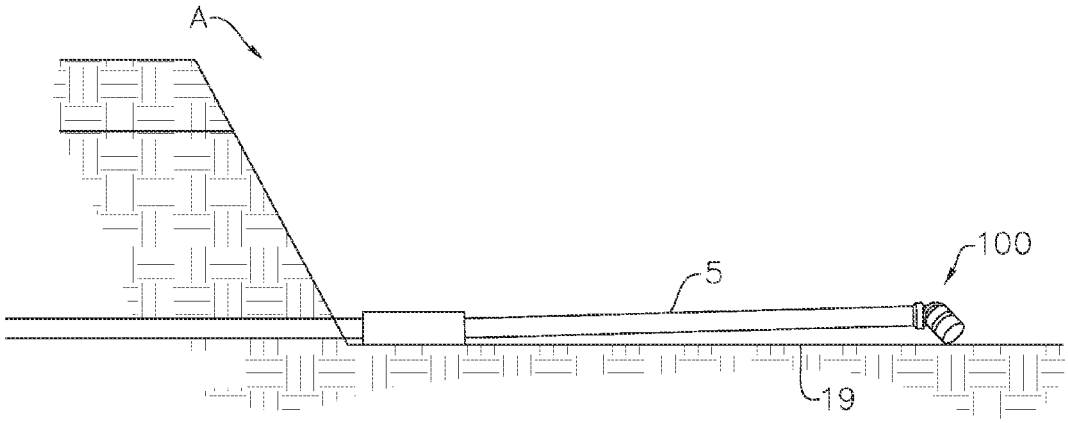
FIG. 1B is a representation of a water containment system without water with an embodiment of the current invention.

The water skimmer 100 may further include one or more supports 17 integral to or in communication with said conduit 1 as seen in FIG. 2-8. The one or more supports 17 are adapted to contact the bottom 19 of the water containment system when the water containment system is holding little or no water as seen in FIG. 1B. The one or more supports 17 hold the conduit 1 substantially above the bottom 19 of the water containment system. The conduit 1 is substantially above the bottom 19 of the water containment system when the conduit 1 is not in contact with the bottom 19 of the water containment system. In one embodiment, connector 15 may act as a support 17. The one or more supports 17 may comprise support structures 17', 17", 17'" as seen in FIGS. 3, 5 and 6. The one or more supports 17 may comprise float material 7 in the interior of the one or more supports 17 or as the one or more supports 17 as seen in FIG. 6. In one embodiment, the one or more supports 17 comprise foam core pipe. The one or more supports 17 may be removably attached to the conduit 1 such that the one or more supports 17 may be removed from the conduit 1. In one embodiment, the one or more supports 17 may be threadingly engaged to the conduit 1. In other embodiments, the one or more structures 17 may be chemically engaged, such as through adhesives, or mechanically engaged, such as through O-rings or friction fits, to the conduit 1. In another embodiment, the one or more supports 17 may be removed and replaced with one or more supports 17 having differing amounts of float material 7.

In one embodiment, water skimmer 100 may comprise a cover 18 adapted to be adjustable to cover or uncover one or more of the water apertures 3 such that water may or may not, respectively, flow through said water aperture 3. The cover 18 may be any material or structure which allows one or more water apertures 3 to be securely covered or uncovered. Examples of such material or structure are, but are not limited to, neoprene or rubber sleeves or PVC, ABS or HDPE structures. The one or more water apertures 3 are securely covered or uncovered if the status of the one or more water apertures 3 as covered or uncovered does not change during the use of the water skimmer 100. In one embodiment, the cover is a rubber sleeve 18 fitted over the conduit 1 in such a way as to allow the sleeve to be positioned over one or more water apertures 3. The cover 18 may be adapted to simultaneously cover or uncover the one or more air apertures 11. In another embodiment, the cover 18 is a rigid structure which mechanically engages the conduit to cover one or more water apertures 3 and/or air apertures 11.

The water apertures 3 are adapted to allow water into the conduit 1 at a predetermined rate. The predetermined rate is equal to the flow rate of water through one predetermined water aperture 30. The flow rate of water is the amount of water passing a point within a period of time where a known head 13 of water is above said point. "One predetermined water aperture" 30 refers to a single aperture of set size. The size of a predetermined water aperture 30 is different for a selected predetermined rate. For example, one predetermined water aperture 30 one inch in diameter has a selected predetermined rate of one, while one predetermined water aperture 30 two inches in diameter has a selected predetermined rate of 2. The current invention comprises one or more water apertures 3 having a size less than the size of the predetermined water aperture 30 to create a flow rate of water through said water apertures 3 at or about the flow rate of water through one predetermined water aperture 30. For example, to create a selected predetermined flow rate of 1.25, which would usually require one predetermined water aperture 30 of 1.25 inches in diameter, the current invention comprises one water aperture 3 of 0.75 inch in diameter and one water aperture 3 of one inch in diameter. The size and number of water apertures 3 may be adapted to create a flow rate of water through said water apertures 3 at or about the flow rate of water through one predetermined water aperture 30. Examples of differing sizes and numbers of water apertures can be found in Tables 1-3 and FIGS. 9F, 9H, and 9M.

Figure 9:
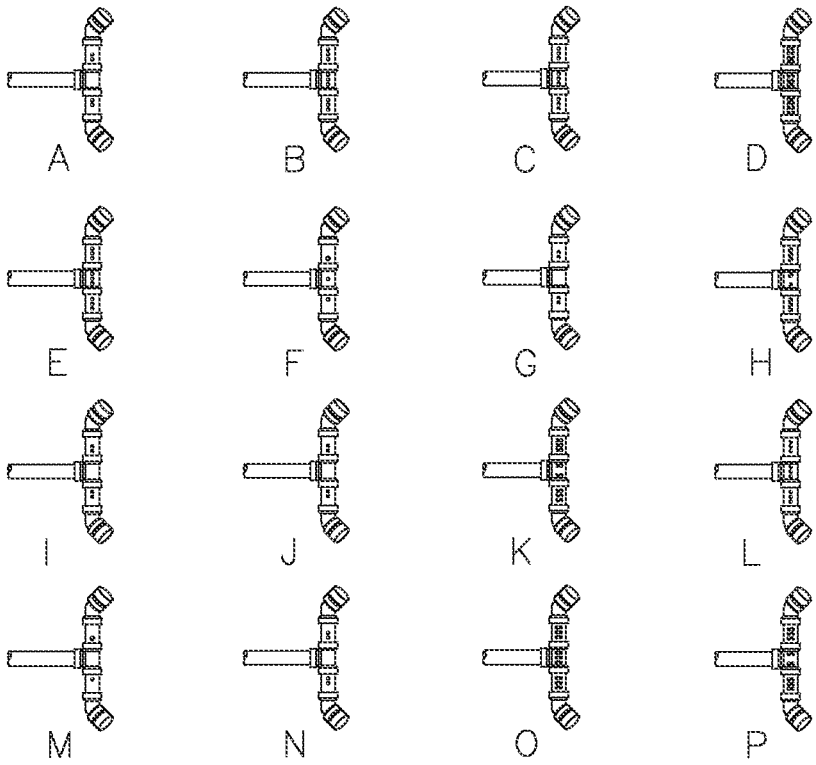
FIGS. 9A-P are bottom views of different aspects of an embodiment of the current invention.

In one embodiment, the conduit 1 comprises four water apertures 3 that are 0.5 inches in diameter to provide a flow rate of water at or about the flow rate of a one inch predetermined water aperture 30 as shown in FIG. 9I and Table 5.

In one embodiment, the conduit 1 comprises nine water apertures 3 that are 0.5 inches in diameter to provide a flow rate of water at or about the flow rate of a one and one-half inch predetermined water aperture 30 as seen in FIG. 9B and Table 6.

In one embodiment, the conduit 1 comprises four water apertures 3 that are 1.0 inches in diameter to provide a flow rate of water at or about the flow rate of a two inch predetermined water aperture 30 as seen in FIG. 9J and Table 7.

In one embodiment, the conduit 1 comprises nine water apertures 3 that are 1.0 inches in diameter to provide a flow rate of water at or about the flow rate of a three inch predetermined water aperture 30 as seen in FIG. 9C and Table 8.

Other nonexhaustive embodiments of the size and number of water apertures 3 can be seen in Table 4 and the corresponding Figures.

TABLE 1

| Predetermined Water Aperture 30 of 5.5 inches as seen in FIG. 9H: | |
|---|---|
| Size of Water Apertures 3 (inches) | Number of Water Apertures 3 |
| 1.5 | 1 |
| 2 | 7 |

TABLE 2

| Predetermined Water Aperture 30 of 1.75 inches as seen in FIG. 9F: | |
|---|---|
| Size of Water Apertures 3 (inches) | Number of Water Apertures 3 |
| 0.5 | 1 |
| 0.75 | 1 |
| 1.5 | 1 |

TABLE 3

| Predetermined Water Aperture 30 of 1.25 inches as seen in FIG. 9M: | |
|---|---|
| Size of Water Apertures 3 (inches) | Number of Water Apertures 3 |
| 0.75 | 1 |
| 1 | 1 |

TABLE 4

| Predetermined Water | Number of Water Apertures 3 | | As seen in |
|---|---|---|---|
| Aperture 30 (inches) | Size (inches) | Number | FIGURE |
| 0.5 | 0.25 | 4 | 9A |
| 0.75 | 0.25 | 9 | 9E |
| 1.25 | 0.25 | 25 | (not shown) |
| 1.75 | 0.25 | 49 | (not shown) |
| 2.5 | 0.5 | 25 | (not shown) |
| 2.5 | 1.5 or 1.25 | 4 | 9N |
| 3.5 | 0.5 | 49 | (not shown) |
| 3.5 | 1.75 | 4 | 9G |
| 4 | 1 | 16 | 9K |
| 4 | 2 | 4 | (not shown) |
| 4.5 | 0.75 | 36 | (not shown) |
| 4.5 | 1.5 | 9 | 9O |
| 5 | 1 | 25 | 9D |
| 5 | 1.25 | 16 | (not shown) |
| 5.5 | 0.25 | 484 | (not shown) |
| 5.5 | 0.5 | 121 | (not shown) |
| 6 | 1.5 | 16 | (not shown) |
| 6 | 2 | 9 | 9L |
| 8 | 1 | 64 | (not shown) |
| 8 | 2 | 16 | 9P |

TABLE 5

| Predetermined Water Aperture 30 (inches) | Size of Water Apertures 3 (inches) | Number of Water Apertures 3 | As seen in FIGURE |
|---|---|---|---|
| 1 | 0.25 | 16 | (not shown) |
| 1 | 0.5 | 4 | 9I |

TABLE 6

| Predetermined Water Aperture 30 (inches) | Size of Water Apertures 3 (inches) | Number of Water Apertures 3 | As seen in FIGURE |
|---|---|---|---|
| 1.5 | 0.25 | 36 | (not shown) |
| 1.5 | 0.5 | 9 | 9B |
| 1.5 | 0.75 | 4 | (not shown) |

TABLE 7

| Predetermined Water Aperture 30 (inches) | Size of Water Apertures 3 (inches) | Number of Water Apertures 3 | As seen in FIGURE |
|---|---|---|---|
| 2 | 0.25 | 64 | (not shown) |
| 2 | 0.5 | 16 | 9B |
| 2 | 1 | 4 | 9J |

TABLE 8

| Predetermined Water Aperture 30 (inches) | Size of Water Apertures 3 (inches) | Number of Water Apertures 3 | As seen in FIGURE |
|---|---|---|---|
| 3 | 0.25 | 144 | (not shown) |
| 3 | 0.5 | 36 | (not shown) |
| 3 | 0.75 | 16 | (not shown) |
| 3 | 1 | 9 | 9C |
| 3 | 1.5 | 4 | (not shown) |

The current invention includes a method of removing water from a water containment system by providing a water skimmer having a conduit, which may be comprised of one or more conduit structures, and float material. The conduit has a defined height and defines one or more air apertures and one or more water apertures. The float material and height of the conduit may be adapted to maintain between approximately a 1.5 inch to 6 inch head of water above the water apertures while maintaining the air apertures at or above the water level of said water containment system. The number and size of the water apertures affects the flow rate of water through the water skimmer. The number and size of the water apertures are adapted to provide a flow rate equal to the predetermined rate of one predetermined water aperture as discussed above. The method of the current invention includes connecting the water skimmer to a water outlet. The water outlet may be a pipe. The water skimmer is placed into the water containment system allowing water from said water containment system to move through the water apertures to said water outlet. The flow of water through the water apertures may be gravity fed and may additionally include pumping or suction to further facilitate the flow of water. The water outlet is in communication with an area outside the water containment system.

In one aspect of the invention, the water outlet is adapted to move vertically in relation to said water level such that the water outlet does not impede the ability of the water skimmer to remain at or about the surface of the water level of the water containment system such that the head of water is substantially consistently between approximately 1.5 and 6 inches deep above the one or more water apertures and the one or more air apertures are at or above the water level as described herein.

Certain modifications and improvements will occur to those skilled in the art upon a reading of the foregoing description. All such modifications and improvements of the present invention have been deleted herein for the sake of conciseness and readability.

Numerous other aspects of embodiments, embodiments, features, and advantages of the present invention will appear from the description and the accompanying drawings. In the description and/or the accompanying drawings, reference is made to exemplary aspects of embodiments and/or embodiments of the invention, which can be applied individually or combined in any way with each other. Such aspects of embodiments and/or embodiments do not represent the full scope of the invention. Reference should therefore be made to the claims herein for interpreting the full scope of the invention.

What is claimed is:

1. A water skimmer for removing water from a water containment system through a water outlet comprising;

(i) a conduit having a height comprised of one or more conduit structures and defining a top side and a bottom side; and (ii) float material;

wherein said conduit defines one or more air apertures on the top side of the conduit and one or more water apertures on the bottom side of the conduit;

wherein the float material and height of the conduit are adapted to maintain between approximately a 1.5 inch to 6 inch head of water above the water apertures and maintain the air apertures at or above the water level of said water containment system;

wherein water from the water containment system is gravity fed through the water apertures; and wherein the flow rate of said water through said water apertures is determined by the number and size of the water apertures.

2. The water skimmer according to claim 1, further comprising (i) at least one connector integral to or in communication with said conduit; wherein said connector is adapted to engage a water outlet; and (ii) one or more supports integral to or in communication with said conduit;

wherein said supports are adapted to hold the conduit substantially above the bottom of said water containment system when said supports contact said bottom; and wherein said float material is integral to or in communication with said conduit, said at least one connector, said one or more supports, or any combination thereof.

3. The water skimmer according to claim 1, further comprising (i) at least one connector integral to or in communication with said conduit; wherein said connector is adapted to engage a water outlet; and (ii) one or more supports integral to or in communication with said conduit;

wherein said supports are adapted to hold the conduit substantially above the bottom of said water containment system when said supports contact said bottom; and wherein said conduit, said at least one connector, said one or more supports, or any combination thereof comprise solid core pipe, foam core pipe, or any combination thereof.

4. The water skimmer according to claim 3, wherein said float material is in communication with said solid core pipe, said foam core pipe, or any combination thereof.

5. The water skimmer according to claim 1, further comprising (i) at least one connector integral to or in communication with said conduit; wherein said connector is adapted to engage a water outlet; and (ii) one or more supports integral to or in communication with said conduit;

wherein said supports are adapted to hold the conduit substantially above the bottom of said water containment system when said supports contact said bottom;

wherein said conduit, said at least one connector, said one or more supports, or any combination thereof is comprised of polyvinyl chloride, acrylonitrile butadiene styrene, high-density polyethylene, or any combination of the proceeding.

6. The water skimmer according to claim 1, wherein said float material is foam core pipe.

7. The water skimmer according to claim 1, further comprising a connector integral to or in communication with said conduit; and wherein said connector is adapted to engage said water outlet.

8. The water skimmer according to claim 1, wherein said skimmer further comprises one or more supports integral to or in communication with said conduit; and wherein said supports are adapted to hold the conduit substantially above the bottom of said water containment system when supports contact said bottom.

9. The water skimmer according to claim 8, wherein said one or more supports are removably attached to said conduit.

10. The water skimmer according to claim 8, wherein at least one of said supports is comprised of foam core acrylonitrile butadiene styrene pipe.

11. The water skimmer according to claim 1, further comprising a cover in communication with said conduit; wherein said cover is adapted to be adjustable to cover or uncover one or more of the water apertures.

12. The water skimmer according to claim 1, further comprising two or more water apertures wherein the size of said water apertures are the same, different, or any combination thereof.

13. The water skimmer according to claim 1, wherein the number of said water apertures is greater than one;

wherein the size of said water apertures is less than the size of a predetermined water aperture; and wherein the flow rate of water through said water apertures is at or about the flow rate of water through one predetermined water aperture.

14. The water skimmer according to claim 1, wherein the number of the water apertures is greater than one;

wherein the size of the water apertures is less than one inch; and wherein the flow of water through said water apertures is at or about the flow rate of a one inch size predetermined water aperture.

15. The water skimmer according to claim 1, wherein the number of said water apertures is greater than one;

wherein the size of the water apertures is less than 1.5 inches; and wherein the flow of water through said water apertures is at or about the flow rate of a 1.5 inch size predetermined water aperture.

16. The water skimmer according to claim 1, wherein the number of said water apertures is greater than one;

wherein the size of the water apertures is less than two inches; and wherein the flow of water through said water apertures is at or about the flow rate of a two inch size predetermined water aperture.

17. The water skimmer according to claim 1, wherein the number of said water apertures is greater than one;

wherein the size of the water apertures are less than three inches; and wherein the flow of water through said water apertures is at or about the flow rate of a three inch size predetermined water aperture.

18. A method of removing water from a water containment system comprising:

providing water skimmer comprising:

(i) a conduit having a height comprised of one or more conduit structures and defining a top side and a bottom side; wherein said conduit defines one or more air apertures on the top side of the conduit and one or more water apertures on the bottom side of the conduit; and (ii) float material; wherein the float material and height of the conduit are adapted to maintain between approximately a 1.5 inch to 6 inch head of water above the water apertures and maintain the air apertures at or above the water level of said water containment system; and connecting said water skimmer for transferring water from the water containment system to a water outlet;

placing said water skimmer into said water containment system;

allowing water from said water containment system to be gravity fed through the water apertures to said water outlet; and maintaining water outlet in communication with an area outside the water reservoir.

19. The method according to claim 18, wherein said water outlet is adapted to move vertically in relation to said water level.

20. A water skimmer for removing water from a water containment system through a water outlet, comprising:

(i) a conduit having a height comprised of one or more conduit structures and defining a top side and a bottom side; wherein said conduit defines one or more air apertures on the top side of the conduit and one or more water apertures on the bottom side of the conduit;

(ii) one or more supports integral to or in communication with said conduit; wherein said one or more supports are adapted to hold the conduit substantially above the bottom of said water containment system when said supports contact said bottom;

(iii) at least one connector integral to or in communication with said conduit; wherein said connector is adapted to engage said water outlet;

(iv) float material integral to or in communication with the conduit, the one or more supports, the connector, or any combination thereof; and wherein the float material and height of the conduit are adapted to maintain between approximately a 1.5 inch to 6 inch head of water above the water apertures and maintain the air apertures at or above the water level of said water containment system;

wherein water from the water containment system is gravity fed through the water skimmer to a water outlet; and wherein the flow rate of said water through said water skimmer is determined by the number and size of the water apertures.

21. The water skimmer according to claim 20, further comprising:

a cover in communication with said conduit;

wherein said cover is adapted to be adjustable to cover or uncover one or more of the water apertures.

* * * * *